US005853041A

United States Patent [19]

Aoyama

[11] Patent Number: 5,853,041

[45] Date of Patent: Dec. 29, 1998

[54] DIE CASTING DEVICE

[75] Inventor: Shunzo Aoyama, Saitama-ken, Japan

[73] Assignee: Ahresty Corporation, Tokyo, Japan

[21] Appl. No.: 668,769

[22] Filed: Jun. 24, 1996

[30] Foreign Application Priority Data

Sep. 11, 1995 [JP] Japan ..... 7-232417

[51] Int. Cl.[6] ..... B22D 17/12; B22D 17/20

[52] U.S. Cl. ..... 164/312; 164/314

[58] Field of Search ..... 164/312, 314

[56] References Cited

U.S. PATENT DOCUMENTS

| | | | |
|---|---|---|---|
| 3,658,121 | 4/1972 | Douglas | 164/312 |
| 3,810,505 | 5/1974 | Cross . | |
| 4,399,859 | 8/1983 | Marcil | 164/312 X |
| 4,655,280 | 4/1987 | Takahashi . | |
| 4,955,426 | 9/1990 | Akimoto et al. | 164/312 X |
| 4,997,027 | 3/1991 | Akimoto | 164/312 |

FOREIGN PATENT DOCUMENTS

| | | |
|---|---|---|
| 0236097 | 9/1987 | European Pat. Off. . |
| 1211765 | 3/1966 | Germany . |
| 3101841 | 11/1981 | Germany . |
| 3918334 | 12/1989 | Germany . |
| 1-299752 | 12/1989 | Japan . |
| 6-15860 | 3/1994 | Japan . |

*Primary Examiner*—J. Reed Batten, Jr.

*Attorney, Agent, or Firm*—Watson Cole Grindle Watson, P.L.L.C.

[57] ABSTRACT

The device includes a cavity defined by a fixed die and a movable die; a plunger disposed in a runner connected to the cavity in such a manner as to be movable to and from a gate of the cavity; a molten metal inlet formed midway in the runner; wherein molten metal supplied from the molten metal inlet in the cavity is pressurized by the advance of the plunger. This die device further includes an auxiliary die unit having a runner and a molten metal inlet connected to the cavity, which is disposed in a border of the fixed die; wherein excessive solidified metal is produced in the vicinity of the molten metal inlet of the auxiliary die unit.

15 Claims, 13 Drawing Sheets

DIE CASTING DEVICE

FIELD OF THE INVENTION AND RELATED ART STATEMENT

The present invention relates to a die casting device, and particularly to a die casting device including a cavity, a plunger provided in a runner connected to the cavity in such a manner as to be movable to and from a gate of the cavity, and a molten metal inlet formed midway in the runner, wherein molten metal supplied from the molten metal inlet in the cavity is pressurized by the advance of the plunger.

In a die casting device of this type it is necessary to keep molten metal supplied in a cavity hot enough not to be solidified before a pressure is applied to the molten metal, and also to prevent blockage, due to molten metal, of a path between a feed port of a molten metal supply means and a gate of the cavity.

Japanese Patent Laid-open No. Hei 1-299752 discloses a method of coating the surface of a cavity with a heat insulating powder for keeping molten metal in the cavity hot enough to remain in a liquid state before the molten metal is pressurized by a plunger.

Japanese Patent Laid-open No. Hei 6-15860 by the present applicant discloses a casting die device shown in FIG. 14, which is effective in preventing blockage, due to molten metal, of a path from a feed port of a molten metal supply means to a gate of a cavity.

In the above-described casting die device previously proposed by the present applicant, the feed port of the molten metal supply means "b" is provided through a fixed die "a", and an exit "b" of the feed port is connected to a molten metal inlet "j" continuous to a gate "d" of a cavity "c" by way of an excessive molten metal solidifying runner "f" formed in a die mating surface portion "e", whereby blockage of the metal passage is prevented by positively solidifying and removing the molten metal in the exit "b" of the feed port and in the excessive molten metal solidifying runner "f" when a pressure is applied to the molten metal in the cavity "c" by the advance of a plunger "g".

This prior art casting die device, however, has the following disadvantage. In the die device, a casting "h" and excessive solidified metal "i" are produced simultaneously in the cavity "c" and the excessive molten metal solidifying runner "f" which are coated with a heat insulating powder. In such simultaneous production of the casting "h" and the excessive solidified metal "i", a molten metal in the cavity "c" solidifies as quickly as in ordinary die castings, because a heat insulating layer of the heat insulating powder is crushed when a pressure is applied to the molten metal in the cavity "c", causing the molten metal to be brought in contact with dies. On the other hand, the solidification of the excessive molten metal "i" takes a lot of time, because the excessive molten metal "i" is not pressurized and thereby a heat insulating layer of the heat insulating powder remains between the die and the molten metal, thereby slowing down cooling of the excessive molten metal "i", and further, the excessive molten metal "i" is located near the exit "b'" of the feed port hotter than other portions of the die device. As a result, the die open time is determined by the solidifying time of the excessive molten metal "i", to make longer the casting cycle, thus making poor productivity as compared with the ordinary die casting process. Another disadvantage of this casting die device is that the die construction is costly because both the structure for connecting the feed port "b" of the molten metal supply means and the excessive molten metal solidifying runner "f" are required to be provided for individual dies.

OBJECT AND SUMMARY OF THE INVENTION

An object of the present invention is to provide a die casting device including a cavity, and a plunger in a runner connected to the cavity in such a manner as to be movable to and from a gate of the cavity, wherein molten metal in the cavity is pressurized by the advance of the plunger, thereby positively preventing blockage, due to molten metal, of a path from a feed port of a molten metal supply means to the gate of the cavity.

Another object of the present invention is to provide a die casting device capable of solidifying excessive molten metal in an excessive molten metal solidifying runner as quickly as a casting in a cavity, thereby speeding up the casting cycle.

A further object of the present invention is to provide a die casting device capable of reducing the fabrication cost of dies.

To achieve the above objects, according to a preferred mode of the invention, there is provided a die casting device which includes a cavity defined by a fixed die and a movable die; a plunger disposed in a runner connected to the cavity in such a manner as to be movable to and from a gate of the cavity; a molten metal inlet formed midway in the runner; wherein molten metal supplied from the molten metal inlet in the cavity is pressurized by the advance of the plunger, wherein an auxiliary die unit is provided having a runner and a molten metal inlet connected to the cavity, which is disposed in a border of the fixed die; wherein excessive solidified metal is produced in the vicinity of the molten metal inlet of the auxiliary die unit.

This configuration of the die device is effective in building and using the auxiliary die unit in combination with other casting dies and hence in saving the die costs, because dies for casting a product are independent from a structure for supplying and filling molten metal in a die cavity, that is, the auxiliary die unit for solidifying excessive molten metal.

According to a preferred mode of the invention the auxiliary die unit includes an auxiliary fixed die and an auxiliary movable die, the auxiliary movable die being mounted to be opened and closed independently of the movable die.

This configuration is effective in shortening the casting cycle because the opening of the auxiliary movable die is independent from that of the casting movable die and therefore the die opening is not dominated by the excessive molten metal solidifying time which is longer than that of the casting.

According to another preferred mode a molten metal supply channel is formed in the auxiliary fixed die in such a manner as to extend from the back side thereof to a die mating surface portion thereof; a feed port of a molten metal supply means is connected to an inlet of the molten metal supply channel; and an exit of the molten metal channel is connected to the inlet of the molten metal inlet by way of an excessive molten metal solidifying runner formed in the die mating surface portion of the auxiliary die unit; whereby excessive molten metal is produced in a path from the vicinity of the exit of the molten metal supply channel to the molten metal inlet.

This configuration is effective in reliably preventing the blockage, due to molten metal, of the vicinity of the molten metal inlet, and more specifically, in the excessive molten metal solidifying runner from the exit of the molten metal channel to the molten metal inlet of the plunger sleeve, because the molten metal therein can be positively solidified and removed.

According to another preferred mode a cooling pipe is inserted in the excessive molten metal solidifying runner in such a manner as to be retractable in the longitudinal direction of the excessive molten metal solidifying runner from the vicinity of the exit of the molten metal supply channel.

This configuration is effective in further shortening the casting cycle, because excessive molten metal in the auxiliary die unit can be rapidly solidified.

According to another preferred mode a molten metal inlet is formed on the back side of the auxiliary fixed die, and a feed port of a molten metal supply means is directly connected to the molten metal inlet; an excessive solidified metal extraction opening portion is formed in a die mating surface portion of the auxiliary fixed die opposite to the molten metal inlet in such a manner as to be freely opened and closed by the auxiliary movable die; and excessive solidified metal is produced in a path from the molten inlet to the excessive solidified metal extraction opening portion, and is extracted from the excessive solidified metal extraction opening portion.

This configuration is effective in improving the yield in casting, because the flow distance of molten metal from the feed port of the molten metal supply means to the cavity is shortened so that it is possible to minimize a drop and a variation in temperature of molten metal filling the cavity and to reduce excessive molten metal.

According to another preferred mode a recess or projection is formed in or on the auxiliary movable die for forming a lug or depression on or in excessive solidified metal produced in a path from the molten metal inlet to the excessive solidified metal extraction opening portion.

This configuration is effective in positively and easily extracting excessive solidified metal produced in the plunger sleeve from the excessive solidified metal extraction runner.

According to another preferred mode a holding pin protruding into and retracting from the recess is disposed in the auxiliary movable die; and an ejector pin for pushing out the excessive solidified metal from the recess is disposed in the auxiliary movable die.

This configuration is effective in further positively and easily extracting excessive solidified metal produced in the plunger sleeve from the excessive solidified metal extraction runner.

According to another preferred mode the surfaces of the auxiliary movable die and the excessive solidified metal extraction runner, which are brought in contact with each other, are flattened.

This configuration is effective to positively prevent leakage of molten metal from the interface between the auxiliary movable die and the excessive solidified metal extraction runner of the plunger sleeve, because a clearance in the interface can be prevented from being increased even if the auxiliary movable die or the excessive solidified metal extraction runner is deflected due to thermal expansion.

According to another preferred mode the outside diameter of the plunger is formed to be smaller than the inside diameter of the gate of the cavity for forming a clearance in between.

This configuration is effective in positively forcing the plunger into the gate of the cavity, because molten metal in a sufficient amount can be kept between the gate of the cavity and the plunger when the plunger advances to the gate of the cavity, that is, the plunger can be forced into the gate without fail since the inside of the forced portion is still in a semi-liquid state even if the outside side thereof is early solidified.

According to another preferred mode mode described in claim 9, a rib is formed on the inner surface of the gate of the cavity or on the outer surface of the plunger in the direction of the forward/backward travel of the plunger.

This configuration is effective in easily and positively pulling out the plunger even if the plunger is gripped by the forced portion solidified and shrunk in a clearance between the plunger and the gate, because one or more of ribs are formed in the gate or the plunger in the travel direction of the plunger, and more specifically, the grip force (shrinkage force) of the forced portion exerted on the plunger, which is mostly dependent on the wall thickness of the forced portion, is moderated with the aid of grooves formed on the outside or inside of the forced portion by the ribs (the grooves may be cracked lengthwise during solidification shrinkage).

According to another preferred mode a molten metal feedback channel is formed in the runner extending from the molten metal inlet to the gate of the cavity so that part of the molten metal in the runner can be returned to the molten metal inlet therethrough after the plunger moves forward and passes the molten metal inlet.

This configuration is effective in removing the casting from the cavity without fail regardless of the lengthening of the travel distance of the plunger, because the top of the plunger can be always made to reach the gate without the need of changing the plunger and the plunger sleeve to suit the casting volume. This configuration has another effect of making easy the design in structure of the die device, because the longer travel distance of the plunger prevents the dies from interfering with a heater and an insulating material of the molten metal supply means (molten metal pipe) connected to the excessive metal solidifying runner connected to the molten metal inlet.

According to another preferred mode the volume of the molten metal feedback channel is set at such a value as to allow the molten metal in the molten metal feedback channel to cool into a solid-liquid coexistent state (solid phase ratio: 1–99%) during the advance of the plunger.

This configuration is effective to automatically adjust the mount of molten metal filling the cavity in accordance with the pressurized volume of the casting and hence to sufficiently supply molten metal in the cavity even for a casting of a large volume, because molten metal in the molten metal feedback channel becomes viscous. This configuration is more effective in eliminating the need of changing the plunger and/or the plunger sleeve and reduce the frequency of changing the advancing position of the plunger in accordance with a change in the volume of the casting, and hence to make easy the setting of the gate of the cavity in the die designing.

According to another preferred mode the distance from the upper end of the molten metal feedback channel to the gate of the cavity is set in proportion to the pressurized volume of the smallest casting to be produced.

This configuration is effective to extract the casting from the cavity without fail and to eliminate the need of changing the plunger or the plunger sleeve even for a casting of a small volume, because the plunger can be made to positively reach to the gate.

According to another preferred mode the advancing speed of the plunger is changed in proportion to the volume of the casting to be produced.

This configuration is effective to adjust the mount of molten metal supplied to fill the cavity more precisely, because the amount of molten metal returned through the molten metal feedback channel can be adjusted.

DETAILED DESCRIPTION OF THE PREFERRED EMBODIMENT

Hereinafter, preferred embodiments of the present invention will be described in detail with reference to the accompanying drawings.

Embodiment 1

Figure 1:
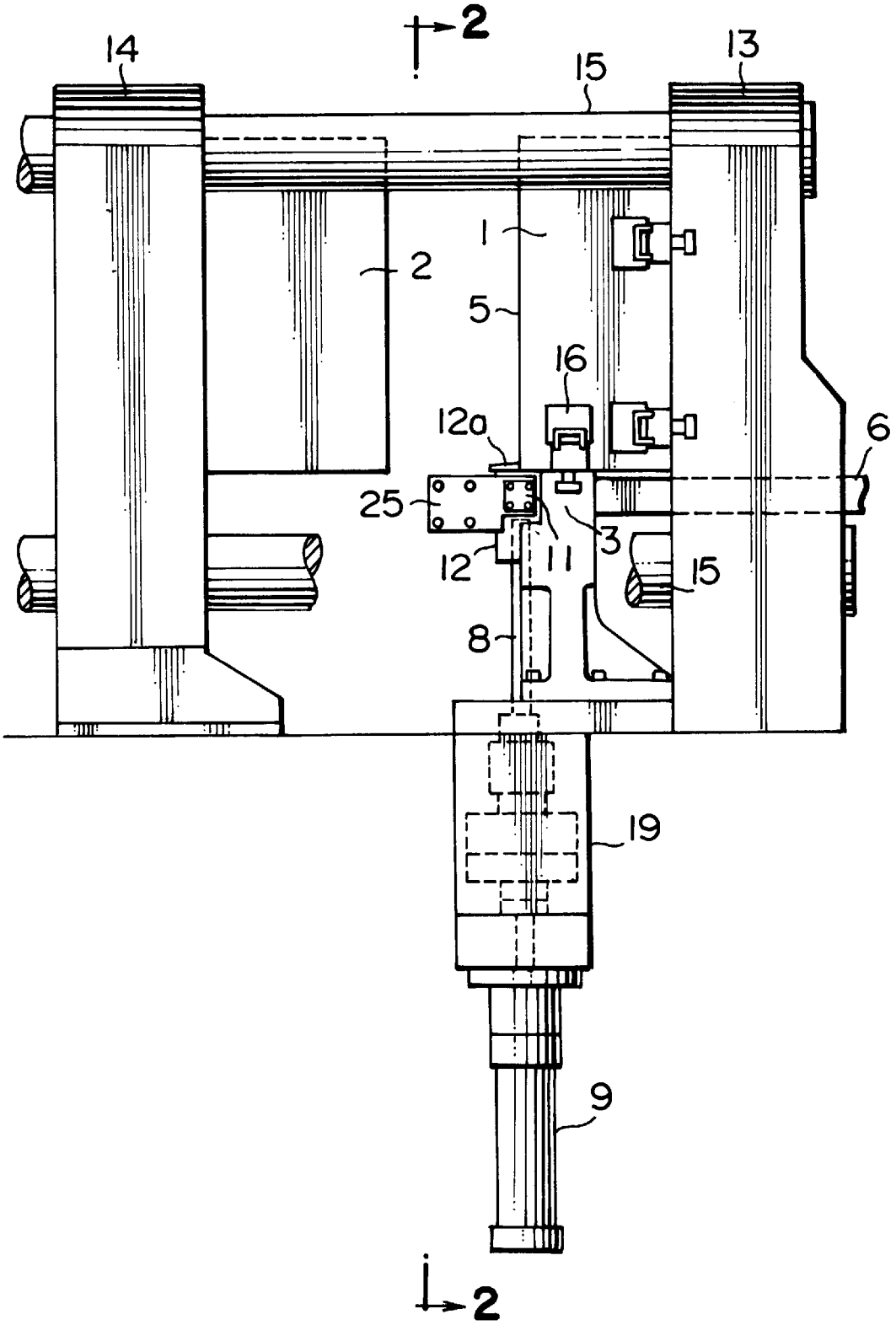
FIG. 1 is a front view of a first embodiment of the die casting device of the present invention.
Figure 2:
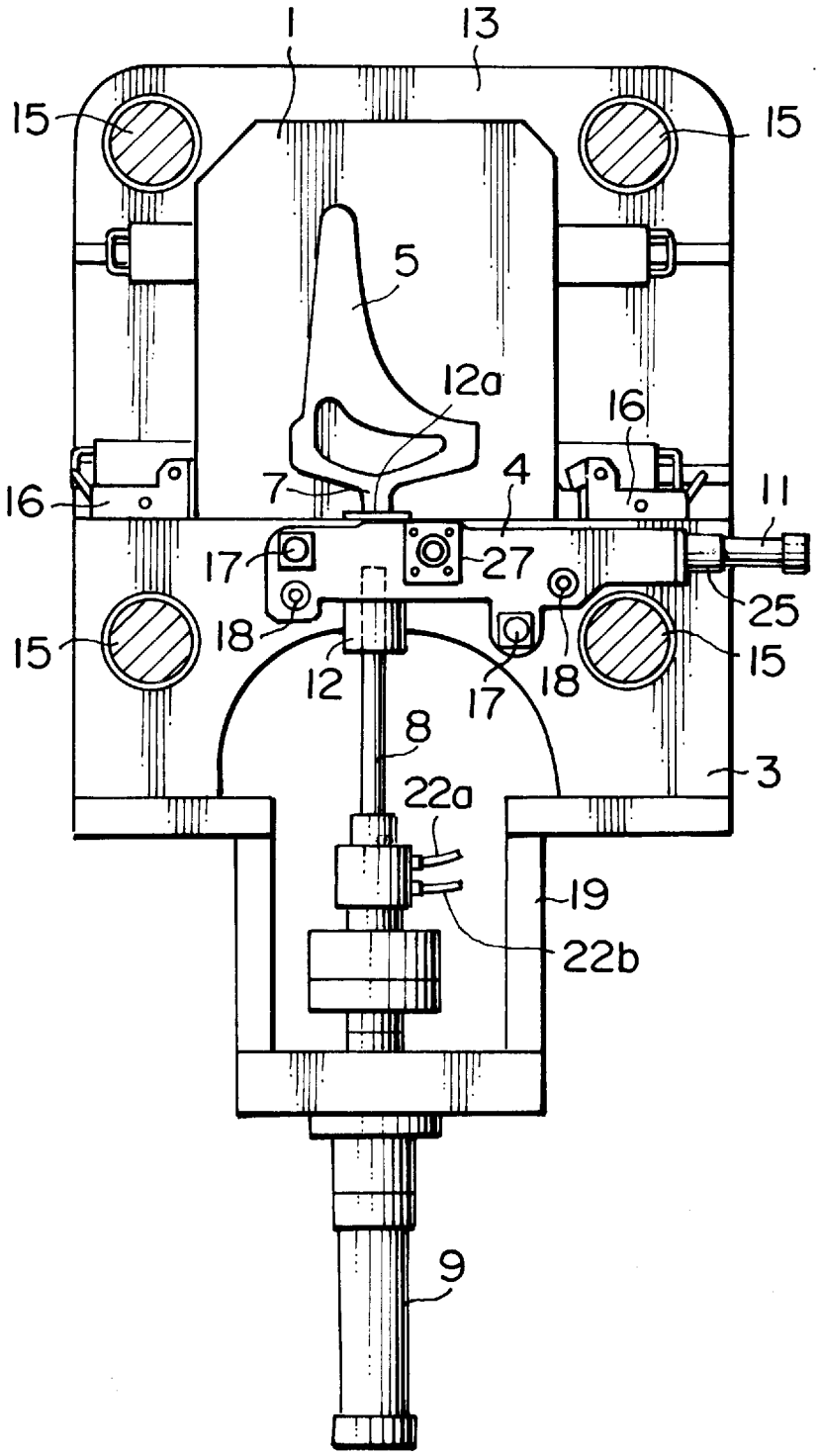
FIG. 2 is a sectional view taken on line 2—2 of FIG. 1.

FIGS. 1 to 5 show a first embodiment of the die casting device of the present invention. It basically includes dies a fixed die 1 and a movable die 2 for casting a product; auxiliary dies, i.e., auxiliary fixed die 3 and auxiliary movable die 4 for solidifying excessive molten metal G and which are disposed in a border of the fixed die 1; a well-known mechanism (not shown) for opening and closing the movable die 2; a molten metal supply means 6 (for example, a molten metal supply pipe) for supplying molten metal to a cavity 5 defined by the fixed die 1 and the movable die 2; a plunger 8 for applying a pressure to molten metal in the cavity 5 and which is disposed in a runner connected to the cavity 5 in such a manner as to be movable to and from a gate 7 of the cavity 5; a pressure cylinder 9 for actuating the plunger 8; a cooling pipe 10 for rapidly cooling the excessive molten metal G; and a driving cylinder 11 for driving the cooling pipe 10. In FIG. 1, reference numeral 13 indicates a stationary platen for mounting the fixed die 1 while reference numeral 14 indicates a movable platen for mounting the movable die 2.

It is to be noted that although the plunger 8 is inserted slidably in the plunger sleeve 12 in this embodiment, it may be directly disposed slidably in the runner connected to the cavity 5 without the plunger sleeve 12, and more specifically, the plunger sleeve 12 is disposed so as to be easily replaceable if it is abraded by friction with the plunger 8, but it is not essential for casting a product and may be. Accordingly, it should be understood that in this specification, the plunger sleeve 12 is substantially equivalent to the runner (or part thereof) connected to the cavity 5.

The auxiliary dies include at least an auxiliary fixed die 3. Namely, the auxiliary movable die 4 for solidifying the excessive molten metal G in combination with the auxiliary fixed die 3 may be substituted for the movable die 2 for casting a product. The auxiliary dies in this embodiment are composed of the auxiliary fixed die 3, and the auxiliary movable die 4 capable of being opened and closed independently of the movable die 2.

A set of the auxiliary dies, which are separable from each other, are disposed in a border of the fixed die 1, that is, in an upper, lower, right or left side portion of the fixed die 1. In this embodiment, the auxiliary fixed die 3 passes through and is supported by tie bars 15, and is also separably fastened to the lower end surface portion of the fixed die 1 by means of a clamp 16. The auxiliary movable die 4 is mounted to the auxiliary fixed die 3 in such a manner as to be freely opened and closed.

The auxiliary movable die 4 is disposed in a die mating surface portion 3*a* of the auxiliary dies in such a manner as to be freely opened and closed in the direction of the opening of the movable die 2 independently of the movable die 2 by means of the opening/closing cylinder 17 and guide levers 18.

Figure 3:
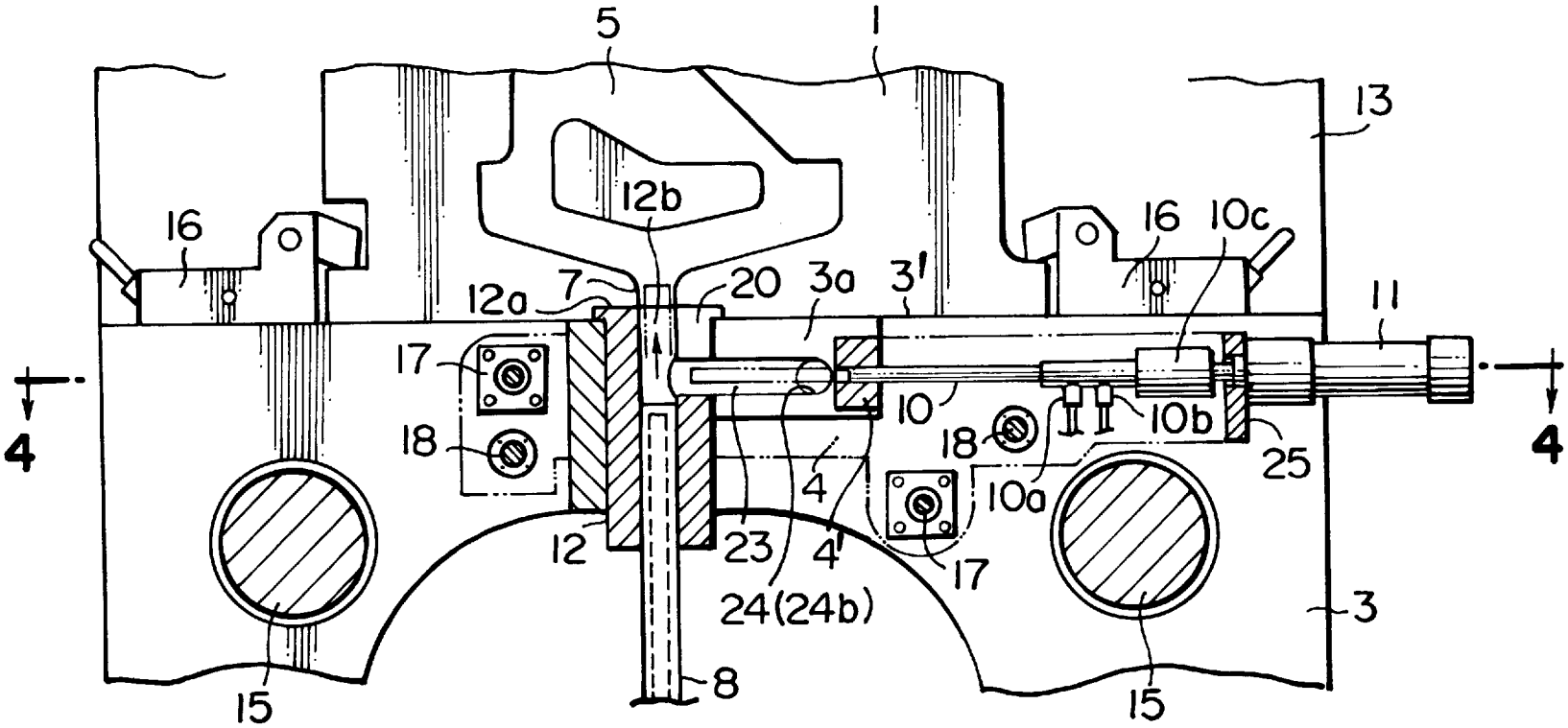
FIG. 3 is an enlarged sectional view of an essential portion in FIG. 2.
Figure 4:
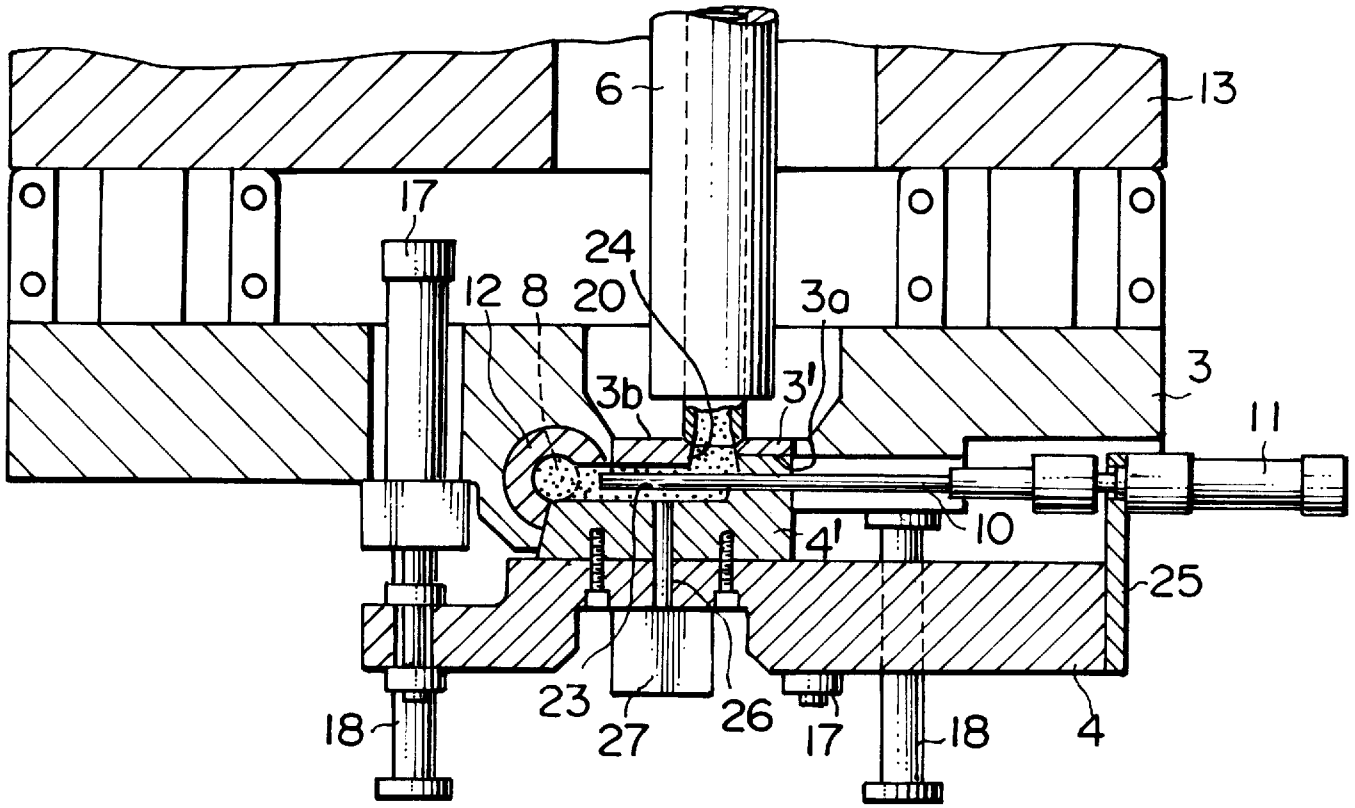
FIG. 4 is a sectional view taken on line 4—4 FIG. 3.
Figure 5A:
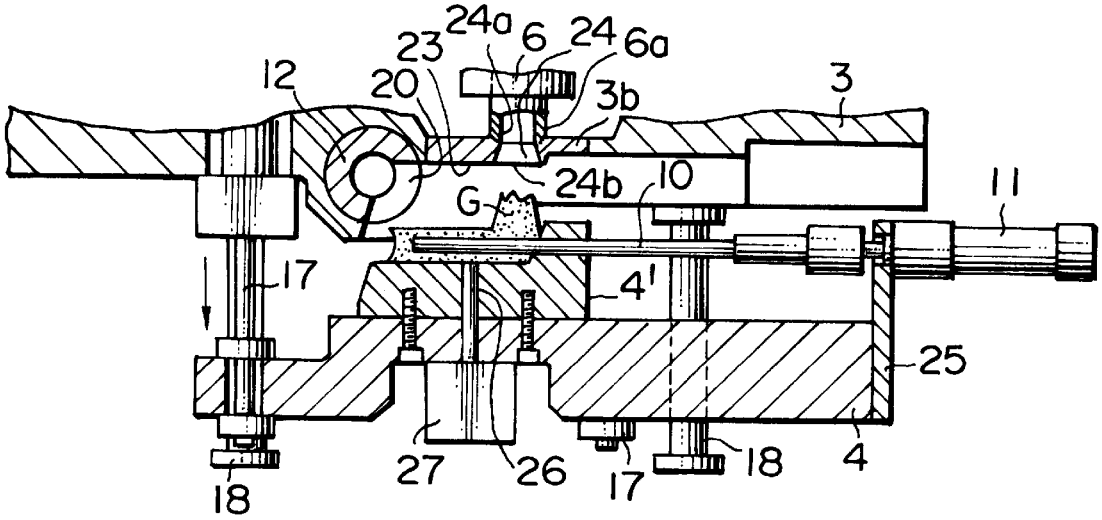
FIG. 5A is a sectional view similar to FIG. 4 illustrating a state that an auxiliary movable die is open.
Figure 5B:
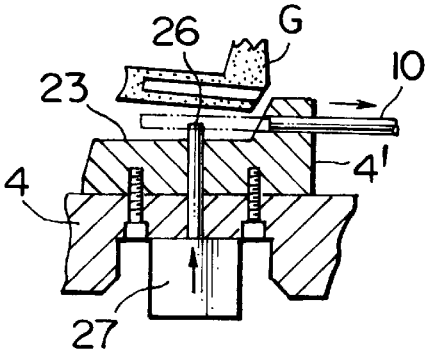
FIG. 5B depicts the forceable separation of solidified excessive metal from the auxiliary movable die of FIG. 5A using an ejector pin.
Figure 6:
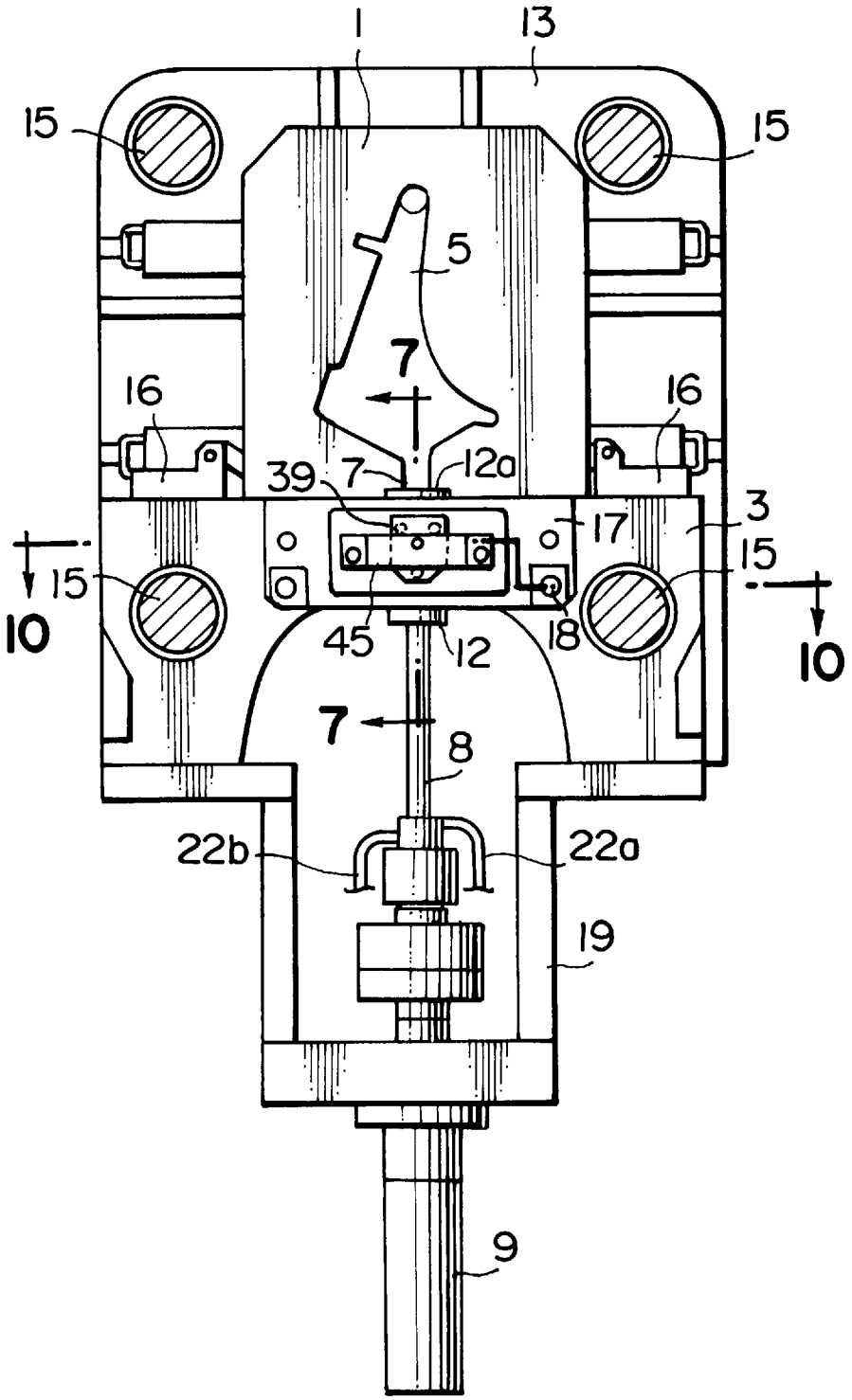
FIG. 6 is a sectional view of a second embodiment of the die casting device of the present invention.

The auxiliary fixed die 3 and the auxiliary movable die 4 do not need to be closed to each other over the entire surface but may be closed only at portions 3' and 4' for solidifying excessive molten metal G, as shown in FIGS. 3 to 5. A runner connected to the cavity 5 is formed in the die mating portions 3' and 4', and the plunger sleeve 12 is disposed in the runner.

A pressure cylinder 9 is mounted to the lower side of the auxiliary fixed die 3 by means of a bracket 19, and the pressure cylinder 9 is connected to the plunger 8. The plunger 8 is slidably inserted in the plunger sleeve 12.

The plunger sleeve 12 is formed in a generally cylindrical shape having a flange 12*a* at the upper end, which is mounted to the auxiliary fixed die 3 with an opening 12*b* at the upper end thereof in contact with the gate 7. A molten metal inlet 20 is provided in the plunger sleeve 12 at a position corresponding to that of an excessive molten metal solidifying runner 23 formed in the die mating surface portion 3*a* of the auxiliary dies.

Preferably, the molten metal inlet 20 should be open by an extent of a quarter-round or more of the plunger sleeve 12 for extracting excessive solidified metal produced therein.

The gate 7, which is formed in the dies (fixed die 1 and movable die 2), is connected to the runner formed in the die mating surface portion 3*a* of the auxiliary dies (auxiliary fixed die 3 and the auxiliary movable die 4) or the opening 12*b* of the plunger sleeve 12.

The flange 12*a* of the plunger sleeve 12 is slightly protruded from the upper end surface of the auxiliary fixed die 3, and it is gently inclined to its upper surface on the side of the auxiliary movable die 4 for guiding the movable die 2. This improves the alignment between the fixed die 1 and the movable die 2.

The plunger 8 has the forward movement limit set in the gate 7 and the backward movement limit set directly under the molten metal inlet 20. The plunger 8 has a hollow structure having an inlet 22*a* and an exit 22*b* for cooling water so that it can be cooled by water circulating in the interior thereof.

Figure 7:
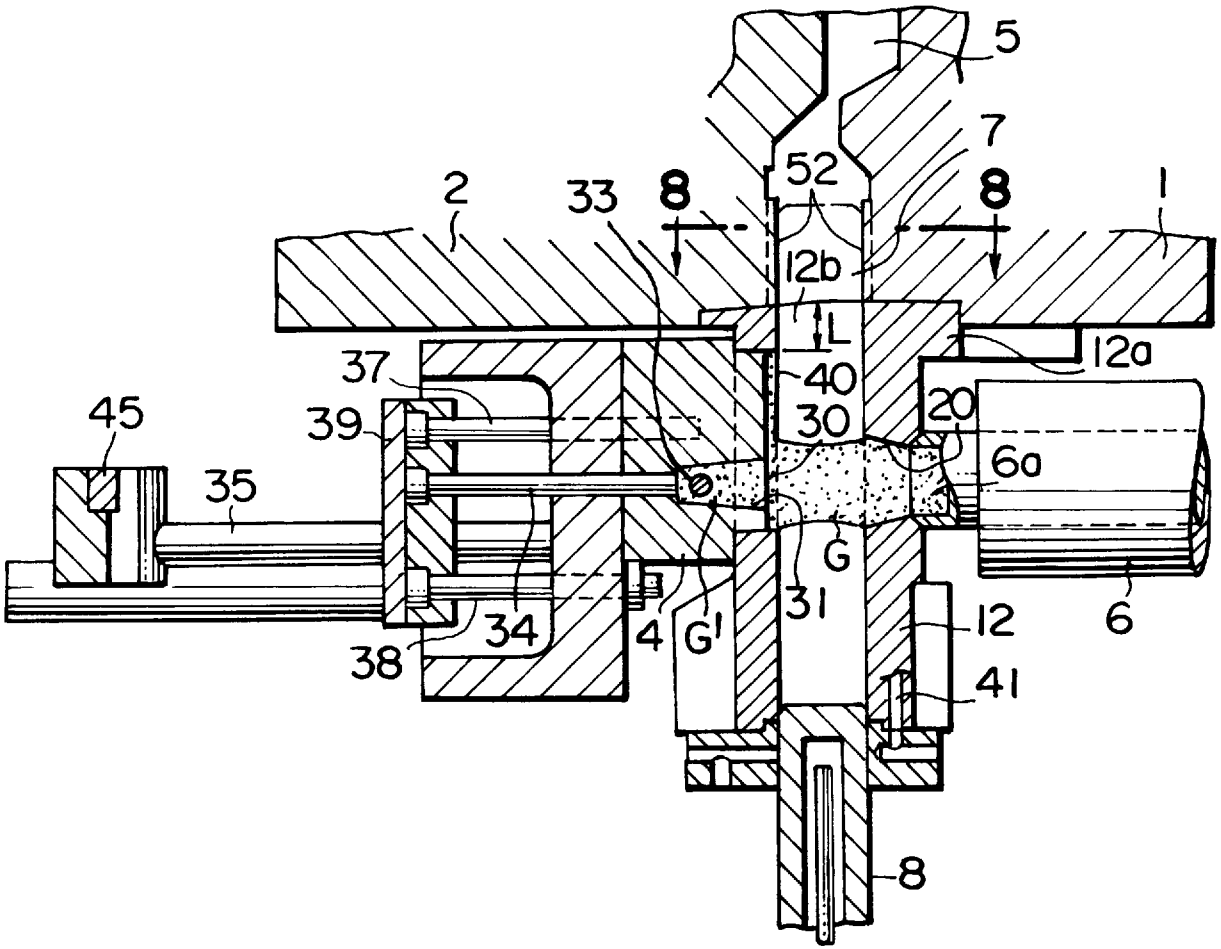
FIG. 7 is an enlarged sectional view taken on line 7—7 in FIG. 6.
Figure 8:
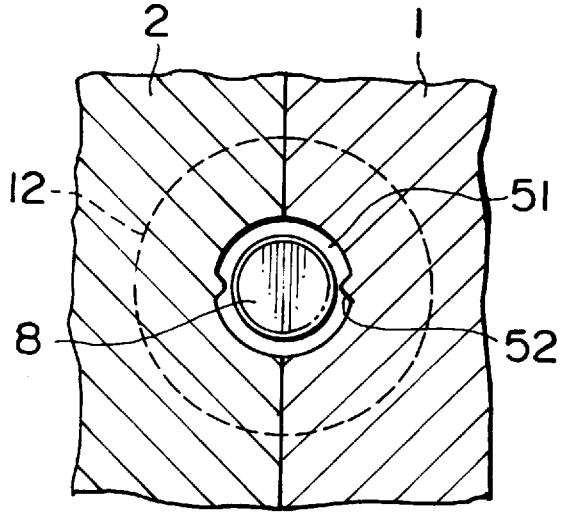
FIG. 8 is a sectional view taken on line 8—8 of FIG. 7.

The plunger 8 has a diameter slightly smaller than the inside diameter of the gate 7 as shown in FIGS. 7 and 8 so that a thin layer of molten metal is formed in a clearance 51 between the gate 7 and the plunger 8 when the plunger 8 enters the gate 7. The clearance 51 should be preferably about 2 mm to 5 mm wide. If it is narrower than 2 mm, molten metal in the clearance 51 may solidify so quickly that the plunger 8 cannot move forward. On the other hand, if it is wider than 5 mm, a forced metal portion $S_1$ formed (cast) not as a product becomes so large that it is a waste of material (molten metal).

Figure 9:
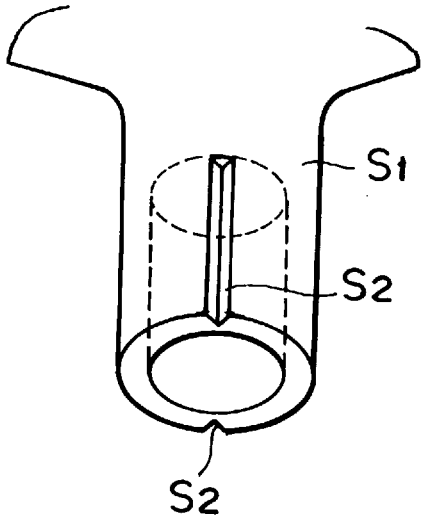
FIG. 9 is a perspective view of a forced portion $S_1$ formed (cast) at a gate.
Figure 10:
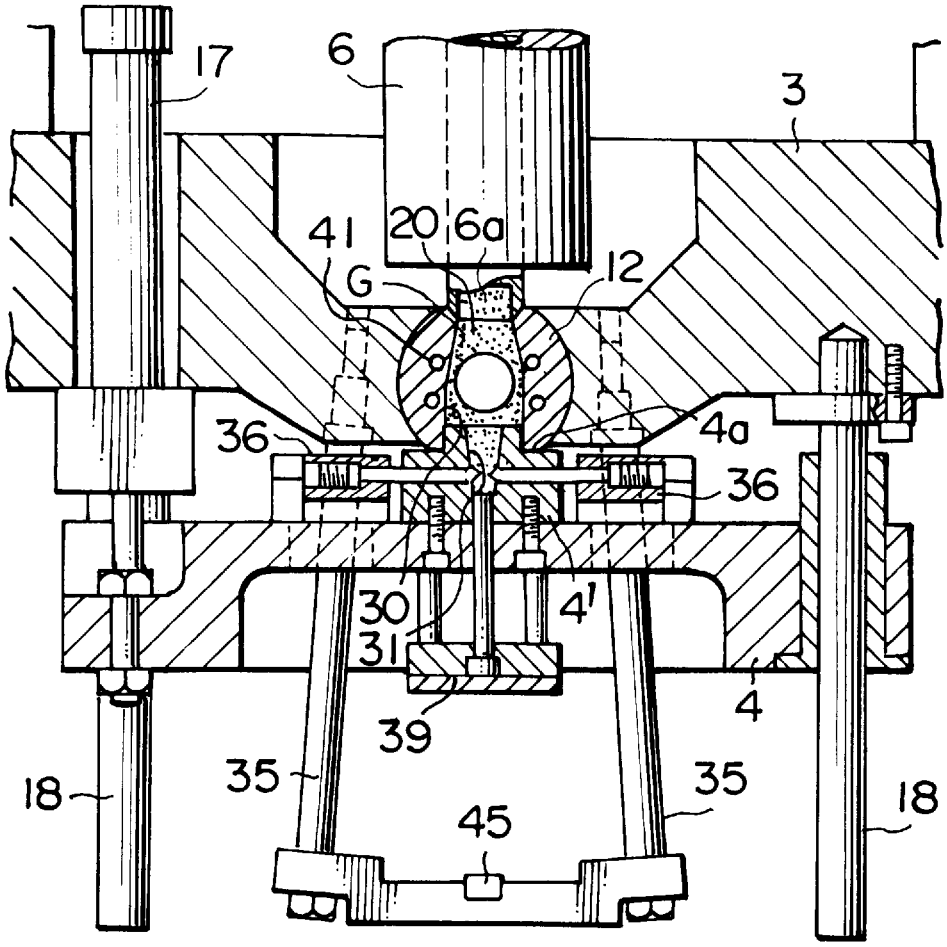
FIG. 10 is an enlarged sectional view taken on line 10—10 in FIG. 6.
Figure 11:
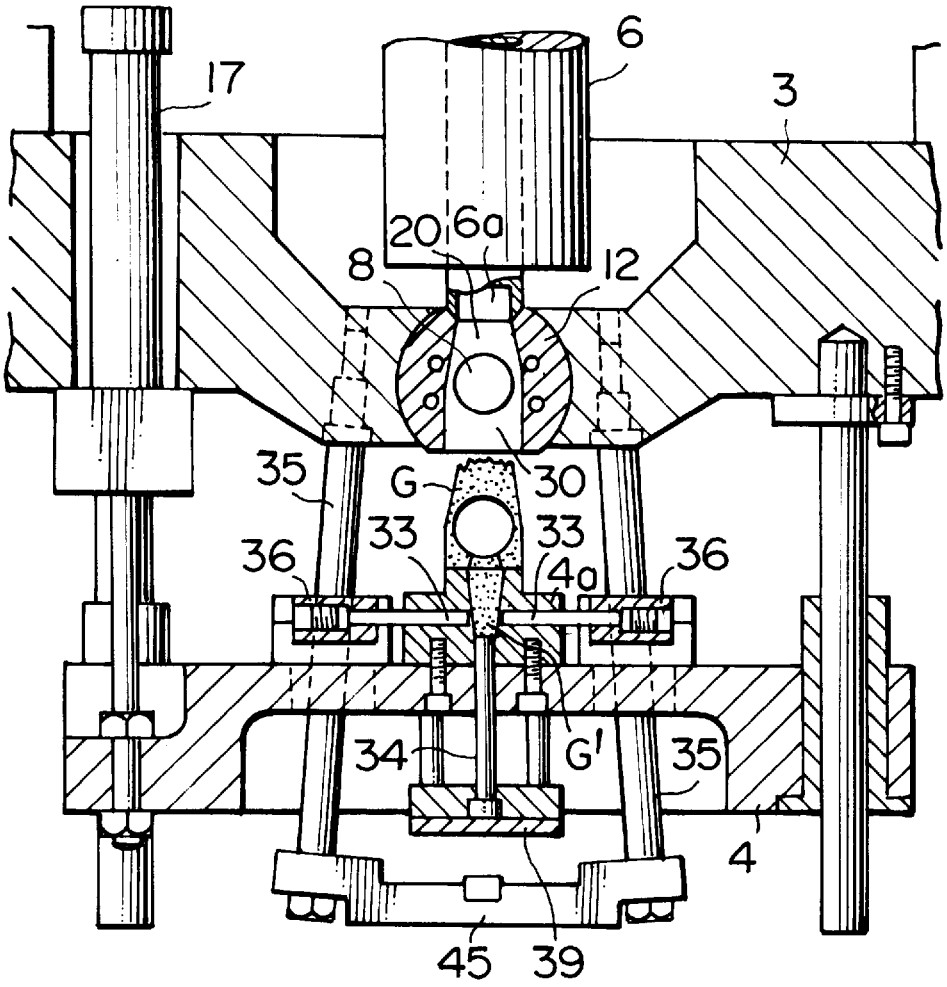
FIG. 11 is an enlarged sectional view, similar to FIG. 10, illustrating a state that an auxiliary movable die is open.

Ribs 52 are formed on the inner surface of the gate 7 (or the outer surface of the plunger 8) in the travel direction of the plunger 8. The ribs 52 form grooves $S_2$ extending in the longitudinal direction, that is, in the travel direction of the plunger 8 in the outside (or the inside) of the metal forced portion $S_1$ in the clearance 51 as shown in FIG. 9. This is effective in moderating the grip of the forced metal portion $S_1$ on the plunger 8 due to solidification shrinkage. The ribs 52, each of which is formed in a generally triangular shape having a height equal to or slightly smaller than the width (2 mm to 5 mm) of the clearance 51, are provided at two or more places (two places in this embodiment) substantially over the entire length along which the plunger 8 advances. It is to be noted that although a plurality of ribs 52 are provided in this embodiment, one rib 52 may be provided.

A molten metal supply channel 24 is formed in the auxiliary fixed die 3 so as to extend from the back side 3*b* to the die mating surface 3*a*. A feed port 6*a* of the molten metal supply means (for example, molten metal supply pipe) 6 is connected to an inlet 24*a* of the molten metal supply channel 24, and an exit 24*b* of the molten metal supply channel 24 is connected to the molten metal inlet 20 of the plunger sleeve 12 via the runner 23 formed in the die mating surface portion 3*a*.

The molten metal supply channel 24 is perforated in parallel to the open/close direction of the auxiliary dies, and more specifically, it is formed as short as possible so that molten metal does not solidify and block the channel, and is also shaped as a funnel enlarged gradually from the inlet 24*a* toward the exit 24*b* so that the excessive solidified metal produced near the exist 24*b* can be removed easily. The inlet 24*a* of the molten metal supply channel 24 is shaped substantially as a concave seat, while the feed port 6*a* of the molten metal supply means 6 is shaped as a spherical contact body. The feed port 6*a* of the molten metal supply means 6 is connected to the inlet 24*a* of the molten metal supply channel 24, with heat-resisting rubber in between.

The runner 23 conveys molten metal from the feed port 6*a* of the molten metal supply means 6 to the cavity 5, and solidifies excessive molten metal not filling the cavity 5. The runner 23 is formed in the die mating surface portion 3*a* into a recess extending from the exit 24*b* of the molten metal supply channel 24 to the molten metal inlet 20 of the plunger sleeve 12.

The cooling pipe 10 is retractably inserted into the runner 23 to rapidly solidify the molten metal in the runner 23. Specifically, a driving cylinder 11 is provided by means of a fastening plate 25 to the end of the auxiliary movable die 4 in line with the exit 24*b* of the molten metal supply channel 24 in the longitudinal direction of the runner 23, and is connected to the cooling pipe 10. The cooling pipe 10 connected to the driving cylinder 11 is retractably inserted from the vicinity of the exit 14*b* of the molten metal supply channel 24 to the vicinity of the molten metal inlet 20 of the plunger sleeve 212 in the longitudinal direction of the runner 23.

The cooling pipe 10 is made of a hollow pipe of a specified length, and has a double walled structure having on one end side a cap 10*c* with an inlet 10*a* and an exit 10*b* for cooling water so that cooling water can be circulated.

In FIGS. 4 and 5, reference numeral 26 indicates an ejector pin to positively push out the excessive solidified metal G produced in the runner 23. The ejector pin 26 is moved by an ejector cylinder 27 mounted on the outside of the auxiliary movable die 4.

When castings are made using the die casting device described above, heat insulating powder is electrostatically applied to the cavity 5, the gate 7, and the runner 23 before casting.

The die clamping mechanism is then actuated to close the dies (fixed die 1 and movable die 2), and simultaneously, the die opening/closing cylinder 17 is actuated to close the auxiliary dies (auxiliary fixed die 3 and auxiliary movable die 4). At this time, the plunger 8 and the cooling pipe 10 are set ready near the molten metal inlet 20 of the plunger sleeve 12 and the cooling pipe 10 near the exit 24*b* of the molten metal supply channel 24, respectively.

Subsequently, molten metal is channeled from the feed port 6*a* to the molten metal supply channel inlet 24*a* of the auxiliary fixed die 3 through the molten metal supply means 6 connected to a holding furnace (not shown) by reducing a pressure in the cavity 5 or applying a pressure to the holding furnace. The molten metal further flows in a route (molten metal supply channel 24→exit 24*b* of molten metal supply channel 24 →runner 23→molten metal inlet 20 of plunger sleeve 12 →plunger sleeve 12→gate 7→cavity 5). The molten metal thus fills the cavity 5.

The pressure cylinder 9 is then actuated to advance the plunger 8 toward the gate 7. The molten metal inlet 20 in the plunger sleeve 12 is closed by the advancing plunger 8, and the molten metal in the cavity 5 is pressurized by the plunger 8 through the molten metal in the gate 7 as the plunger 8 advances. In this condition, the molten metal in the cavity 5 solidifies and becomes a product.

Next, supply of the molten metal from the molten metal supply means 6 stops simultaneously when the molten metal inlet 20 of the plunger sleeve 12 is closed by the plunger 8, and the driving cylinder 11 is actuated to insert the cooling pipe 10 from the vicinity of the exit 24*b* of the molten metal supply channel 24 to the vicinity of the molten metal inlet 20 of the plunger sleeve 12 in the longitudinal direction of the runner 23. The molten metal remaining in the runner 23 is thus cooled forcibly and solidifies rapidly, to produce the excessive solidified metal G.

The plunger 8 is then retracted downward to the original position, and the movable die 4 is opened to unload the casting from the cavity 5. The opening/closing cylinder 17 is actuated simultaneously, just before or just after the unloading of the casting, to open the auxiliary movable die 4 for separating the excessive solidified metal G from the runner 23. Finally, when the cooling pipe 10 is withdrawn by the driving cylinder 11, to separate the excessive solidified metal G from the auxiliary movable die 4 (see FIG. 5).

In this case, if the excessive solidified metal G does not separate from the auxiliary movable die 4 when the cooling pipe 10 is withdrawn, the ejector cylinder 27 is actuated to forcibly separate it with the ejector pin 26.

The above-described operation is repeated to produce castings.

Embodiment 2

The second embodiment of the die casting device of the present invention will be described below with reference to FIGS. 6 to 11. Parts corresponding to those in the first embodiment are indicated by the same characters, and the explanation thereof is omitted.

In this die casting device, a feed port 6*a* of a molten metal supply means (for example, molten metal supply pipe) 6 is directly connected to a molten metal inlet 20 of a plunger sleeve 12 mounted on an auxiliary fixed die 3, and an excessive solidified metal extraction opening portion 30 is formed in the plunger sleeve 12 opposite to the molten metal inlet 20, so that excessive solidified metal G, which is produced in a section including the molten metal inlet 20, the excessive solidified metal extraction opening portion 30, and a recess of an auxiliary movable die 4, can be pulled out from the excessive solidified metal extraction opening portion 30.

Specifically, the excessive solidified metal extraction opening portion 30 is formed in the plunger sleeve 12 opposite to the molten metal inlet 20 in such a manner that it is opened and closed by movement of a die mating portion 4' of the auxiliary movable die 4, and that the excessive solidified metal G, which is produced in the section including the molten metal inlet 20, the excessive solidified metal extraction opening portion 30, and the recess of the mating portion 4' of the auxiliary movable die 4, can be extracted from the excessive solidified metal extraction opening portion 30.

In the die mating portion 4' of the auxiliary movable die 4, the working surface 4*a* against the excessive solidified metal extraction opening portion 30 in the plunger sleeve 12 is flattened, and a recess or projection (recess in this embodiment) 31 is formed in the surface opposite to the molten metal inlet 20 to form a lug or depression (lug in this embodiment) G' on the excessive solidified metal G.

The die mating portion 4' of the auxiliary movable die 4 is provided with holding pins 33 and an ejector pin 34 to extract excessive solidified metal G from the excessive solidified metal extraction opening portion 30 with the holding pins 33 engaged with the lug G'.

The holding pins 33 are disposed in such a manner that they can protrude into and retract from the recess 31 of the auxiliary movable die 4. Specifically, the two holding pins 33 are located on the right and left sides of the auxiliary movable die 4 so that they can freely move to and back from the recess 31, and attached movably and adjustably to slide pieces 36 connected slidably to angled rods 35 disposed on the auxiliary fixed die 3 in such a manner as to slightly spread in the open direction of the auxiliary die.

The ejector pin 34 is fixed on an ejector plate 39 mounted on the auxiliary movable die 4 by means of a return pin 37 and a back stop pin 38 in such a manner as to be movable in the open direction of the auxiliary die 2, with the top end thereof contained in the recess 31 of the auxiliary movable die 4 in such a manner that it can press on the lug G' of the excessive solidified metal G.

The mechanism for actuating the holding pins 33 and the ejector pin 34 is not limited to those shown in this embodiment. For example, only one holding pin 33 may be provided, which may be actuated by a hydraulic or air cylinder. The ejector pin 34 may be also actuated by a hydraulic or air cylinder.

A molten metal feedback channel 40 is formed in the inner surface of the plunger sleeve 12 to allow part of molten metal to return to the molten metal inlet 20 during the plunger 8 advances to apply a pressure to molten metal in the cavity. Preferably, the volume of the molten metal feedback channel 40 should be set at such a value as to allow the molten metal in the channel 40 during the advance of the plunger 8 to cool by contact with the channel 40 and the plunger 8 into a solid-liquid coexistent state (solid phase ratio: 1 to 99%). It is also preferable to set the distance (L) between the upper end of the molten metal feedback channel 40 and the upper end of the flange 12*a* of the plunger sleeve 12 in proportion to the pressurized volume of the smallest casting. Further, it is preferable to change the advancing speed of the plunger 8 in proportion to the volume of the casting and hence to adjust the solid phase state ratio of the molten metal in the molten metal feedback channel 40. In other words, if the volume of the casting is small, the advancing speed of the plunger 8 is increased to reduce the solid phase ratio of the molten metal in the molten metal feedback channel 40 and hence to prevent an increase in viscosity of molten metal. On the other hand, if the volume of the casting is large, the advancing speed of the plunger 9 is decreased to increase the solid phase ratio and hence to raise the viscosity of molten metal. In this way, when the plunger 8 advances upward to the gate 7, part of the molten metal in the plunger sleeve 12 returns to the molten metal inlet 20 through the molten metal feedback channel 40. After the top end of the plunger 8 passes the upper end of the molten metal feedback channel 40, a pressure is applied to the molten metal in the cavity 5 by way of molten metal in the gate 7, to produce a casting properly. More specifically, if the casting volume is small, that is, the pressurized volume of the casting is small, the pressure on the molten metal in the cavity 5 is not greater than the resistance of the molten metal in the plunger sleeve 12, because a relatively high pressure is exerted on the molten metal from the early stage when the plunger 8 pushes it forward to the gate 7, and the molten metal in the plunger sleeve 12 returns to the molten metal inlet 20 through the molten metal feedback channel 40. As a result, the casting has a pressurized volume greater than the volume of the distance (L) from the upper end of the molten metal feedback channel 40 to the upper end surface of the flange 12*a* of the plunger sleeve 12, and accordingly, the top of the plunger 8 can advance positively beyond the upper surface of the flange 12*a* of the plunger sleeve 12. By contrast, if the casting volume is large, that is, the pressurized volume of the casting is large, the pressure exerted on the molten metal does not increase even when the plunger 8 advances a considerably long distance, as a result of which most of the molten metal in the molten metal feedback channel 40 does not return to the molten metal inlet 20 but is forced from the gate 7 into the cavity 5, to sufficiently make up for a shortage in pressurized volume owing to a change in the volume of the casting. The supply of molten metal in a suitable amount for each casting through the molten metal feedback channel 40 can be further controlled precisely by changing the advancing speed of the plunger 8 in proportion to the volume of the casting to adjust the solid phase ratio of the molten metal in the molten metal feedback channel 40.

In a casting using the die casting device described above, a heat insulating powder is electrostatically applied to the cavity 5 and the gate 7 before the dies (fixed die 1 and movable die 2) and the auxiliary dies (auxiliary fixed die 3 and auxiliary movable die 4) are closed. The excessive solidified metal extraction opening portion 30 is then shut with the die mating surface portion 4' of the auxiliary movable die 4, and the ejector pin 34 is set in the recess 31 of the auxiliary movable die 4 while the holding pins 33 are thrust forward.

Subsequently, molten metal is channeled from the feed port 6*a* of the molten metal supply means 6 directly through the molten metal inlet 20 into the plunger sleeve 12, to fill the cavity 5 through the gate 7. The pressure cylinder 9 is then actuated to advance the plunger 8 toward the gate 7, and thereby molten metal in the cavity 5 is pressurized by way of the molten metal in the gate 7 along with the upward movement of the plunger 8 and solidifies.

During casting, molten metal also fills the recess 31 in the auxiliary movable die 4 which opens and closes the excessive solidified metal extraction opening portion 30, and it further flows around the holding pins 33 previously thrust in the recess 31. As a result, an excessive solidified metal G having the lug G' is formed in the plunger sleeve 12 in the section including the molten metal inlet 20, the excessive solidified metal extraction opening portion 30, and the recess 31, after completion of the advancement of the plunger 8.

Figure 12:
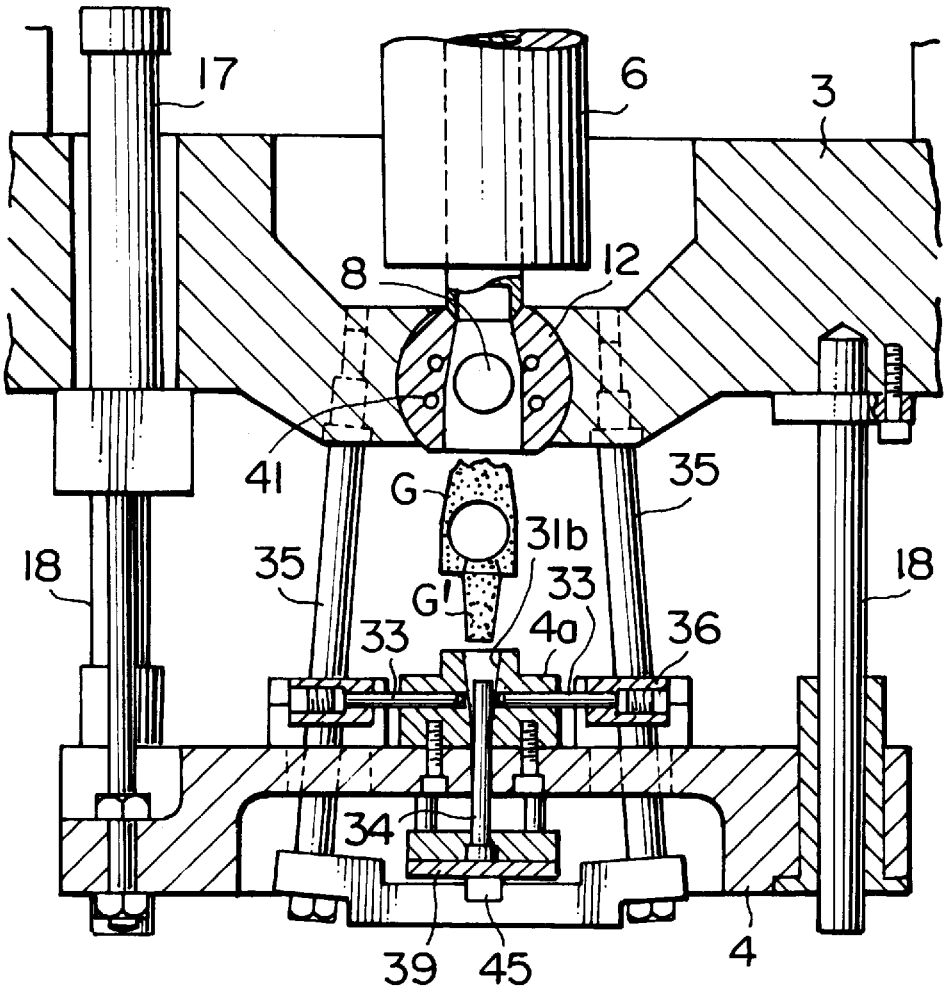
FIG. 12 is an enlarged sectional view, similar to FIG. 10, illustrating a state that the auxiliary movable die is open wider.
Figure 13:
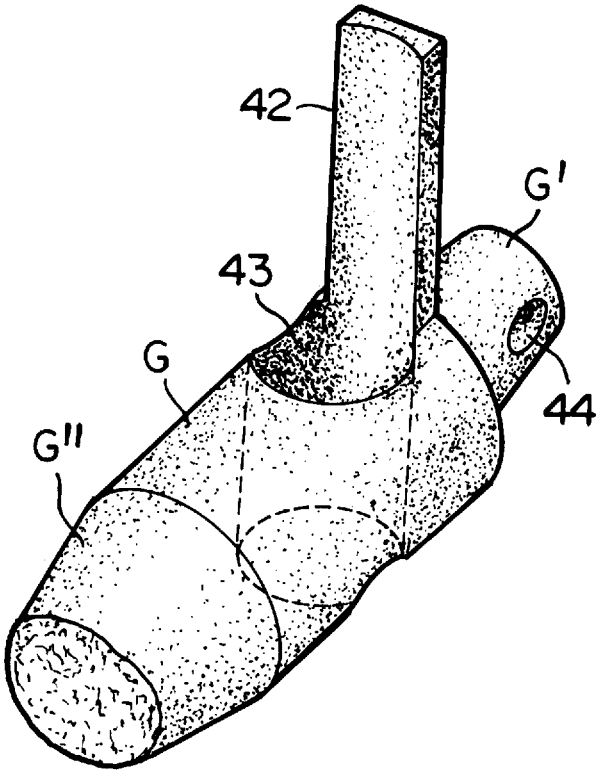
FIG. 13 is a perspective view illustrating excessive solidified metal produced in a plunger sleeve.
Figure 14:
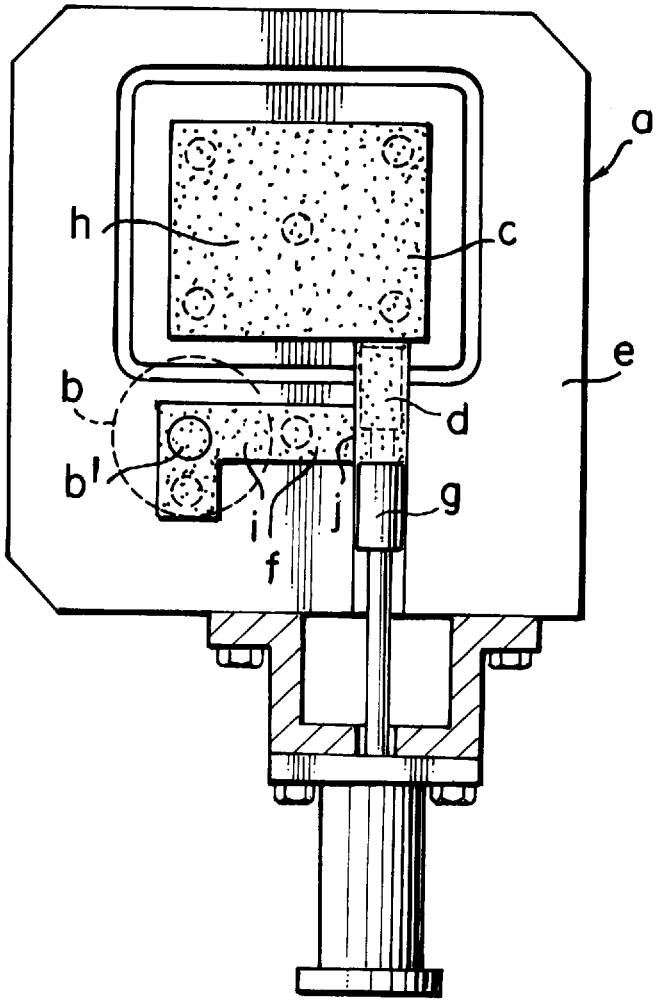
FIG. 14 PRIOR ART
FIG. 14 is a front view illustrating a prior art die casting device, with parts partially cut away.

In FIG. 12, reference numeral 41 indicates a cooling water channel to cool the plunger sleeve 12. In FIG. 13, illustrating the excessive solidified metal, reference numeral 42 indicates a portion of the excessive solidified metal produced in the molten metal feedback channel 40; 43 is a hole perforated by the plunger 8; G' is a lug produced in the recess 31 integrally with the excessive solidified metal G; and 44 is a depression showing a trace engagement with the holding pin 33.

The plunger 8 is then retracted downward to the initial stand-by position, and the dies (fixed die 1 and movable die 2) are opened to extract the casting from the cavity 5. Subsequently, the auxiliary dies (auxiliary fixed die 3 and auxiliary movable die 4) are opened, and the lug G' formed in the recess 31 and retained by the holding pins 33 moves together with the auxiliary movable die 4 and the excessive solidified metal G is pulled out through the excessive solidified metal extraction opening portion 30. When the auxiliary movable die 4 opens, the slide pieces 36 slide on the angled rods 35. The holding pins 33 on the slide pieces 36 thus move outward together with the slide pieces 26 with the tops thereof retreated from the recess 31, and separate from the lug G' (see FIG. 12).

As the auxiliary movable die 4 continues to open, the ejector plate 39 comes into contact with a bumper 45 attached to the ends of the angled rods 35 and shifts relatively toward the auxiliary movable die 4. The ejector pin 34 then protrudes into the recess 31 to press the top of the lug G', and pushes out the excessive solidified metal G from the recess 31 (see FIG. 12).

When the auxiliary movable die 4 closes, the top of the return pin 37 abuts the auxiliary fixed die 3, causing the ejector plate 39 to return to the casting position together with the ejector pin 34.

The above-described operation is repeated to produce castings.

While the preferred embodiments of the invention have been described, such description is for illustrative purposes only, and it is to be understood that changes and variations may be made without departing from the spirit or scope of the following claims.

What is claimed is:

1. In a die casting device comprising:

a cavity defined by a fixed die and a movable die;

a plunger disposed in a runner connected to said cavity in such a manner as to be movable to and from a gate of said cavity;

a molten metal inlet formed midway in the runner;

wherein molten metal supplied from said molten metal inlet in said cavity is pressurized by the advance of said plunger, the improvement comprising:

an auxiliary die unit having a runner and a molten metal inlet connected to said cavity, which is disposed in a border of said fixed die;

wherein excessive solidified metal is produced in the vicinity of the molten metal inlet of said auxiliary die unit.

2. A die casting device according to claim 1, wherein said auxiliary die unit comprises an auxiliary fixed die and an auxiliary movable die, and includes means to move said auxiliary movable die relative to said auxiliary fixed die independently of said movable die.

3. A die casting die according to claim 2, wherein a molten metal supply channel is formed in said auxiliary fixed die in such a manner as to extend from a back side thereof to a die mating surface portion thereof;

a feed port of a molten metal supply means is connected to an inlet of said molten metal supply channel; and an exit of said molten metal channel is connected to the inlet of said molten metal supply inlet by way of an excessive molten metal solidifying runner formed in the die mating surface portion of said auxiliary die unit;

whereby excessive molten metal is produced in a path from the vicinity of the exit of said molten metal supply channel to said molten metal inlet.

4. A die casting device according to claim 3, including a cooling pipe for insertion and retraction in said excessive molten metal solidifying runner in a longitudinal direction of said excessive molten metal solidifying runner from the vicinity of the exit of said molten metal supply channel.

5. A die casting device according to claim 2, wherein a molten metal inlet is formed on the back side of said auxiliary fixed die, and a feed port of a molten metal supply means is directly connected to said molten metal inlet;

an excessive solidified metal extraction opening portion is formed in a die mating surface portion of said auxiliary fixed die opposite to said molten metal inlet in such a manner as to be freely opened and closed by said auxiliary movable die; and excessive solidified metal is produced in a path from said molten inlet to said excessive solidified metal extraction opening portion, and is extracted from said excessive solidified metal extraction opening portion.

6. A die casting device according to claim 5, wherein a recess or projection is formed in or on said auxiliary movable die for forming a lug or depression on or in excessive solidified metal produced in a path from said molten metal inlet to said excessive solidified metal extraction opening portion.

7. A die casting device according to claim 6, wherein a holding pin for protruding into and retracting from said recess is disposed in said auxiliary movable die; and an ejector pin for pushing out the excessive solidified metal from said recess disposed in said auxiliary movable die.

8. A die casting device according to claim 5, wherein the surfaces of said auxiliary movable die and said excessive solidified metal extraction runner, which are brought in contact with each other, are flattened.

9. A die casting device according to claim 1, 3, or 5, wherein the outside diameter of said plunger is formed to be smaller than the inside diameter of the gate of said cavity for forming a clearance in between.

10. A die casting device according to claim 9, a rib is formed on the inner surface of the gate of said cavity or on the outer surface of said plunger in the direction of the forward/backward travel of said plunger.

11. A die casting device according to claim 1, 3, or 5, wherein a molten metal feedback channel is formed in the runner extending from said molten metal inlet to the gate of said cavity so that part of the molten metal in the runner can be returned to said molten metal inlet therethrough after said plunger moves forward and passes said molten metal inlet.

12. A die casting device according to claim 11, wherein the volume of said molten metal feedback channel is set at such a value as to allow the molten metal in said molten metal feedback channel to cool into a solid-liquid coexistent state (solid phase ratio: 1–99%) during the advance of said plunger.

13. A die casting device according to claim 11, wherein the distance from the upper end of said molten metal feedback channel to the gate of said cavity is set in proportion to the pressurized volume of the smallest casting to be produced.

14. A die casting device according to claim 11, wherein the advancing speed of said plunger is changed in proportion to the volume of the casting to be produced.

15. A die casting device comprising:

a fixed die and a movable die which together define a molding cavity having an inlet gate and an inlet runner;

means forming an auxiliary runner connected to said inlet gate;

means forming a molten metal inlet midway along a length of said auxiliary runner; and a plunger movable along said auxiliary runner to pressurize molten metal in said auxiliary runner and force molten metal therein through said inlet gate and into said inlet runner and said molding cavity;

wherein said means forming said auxiliary runner comprises an auxiliary die unit disposed adjacent said fixed die, said auxiliary die unit comprising a fixed auxiliary die and movable auxiliary die, said movable auxiliary die being movable independently of either of said fixed and movable dies.

* * * * *